US007297833B2

(12) United States Patent
Beattie et al.

(10) Patent No.: US 7,297,833 B2
(45) **Date of Patent: *Nov. 20, 2007**

(54) STEAM CRACKING OF LIGHT HYDROCARBON FEEDSTOCKS CONTAINING NON-VOLATILE COMPONENTS AND/OR COKE PRECURSORS

(75) Inventors: David Beattie, Singapore (SG); Richard C. Stell, Houston, TX (US); Alok Srivastava, Houston, TX (US); James N. McCoy, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 636 days.

This patent is subject to a terminal disclaimer.

(21) Appl. No.: 10/851,500

(22) Filed: May 21, 2004

(65) Prior Publication Data

US 2005/0261535 A1 Nov. 24, 2005

(51) Int. Cl.
*C10G 9/14* (2006.01)
*C07C 4/04* (2006.01)

(52) U.S. Cl. ..... 585/652; 585/648; 585/650; 208/132

(58) Field of Classification Search ..... 585/648, 585/650, 652; 208/132
See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | |
| 3,341,429 | A | 9/1967 | Fondrk | |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | |
| 3,505,210 | A | 4/1970 | Wallace et al. | |
| 3,617,493 | A | 11/1971 | Wirth et al. | 208/80 |
| 3,677,234 | A | 7/1972 | Dutkiewicz | |
| 3,718,709 | A | 2/1973 | Simonetta | 260/683 R |
| 3,900,300 | A | 8/1975 | Lehman | |
| 4,199,409 | A | 4/1980 | Skraba | |

(Continued)

FOREIGN PATENT DOCUMENTS

DE 10 93 351 11/1960

(Continued)

OTHER PUBLICATIONS

"Specialty Furnace Design: Steam Reformers and Steam Crackers", presented by T.A. Wells of the M.W. Kellogg Company, 1988 AIChE Spring National Meeting.

(Continued)

*Primary Examiner*—Tam M. Nguyen

(57) ABSTRACT

A process for cracking a light hydrocarbon feedstock containing non-volatile components and/or coke precursors, wherein a heavy hydrocarbon feedstock is added to the contaminated light hydrocarbon feedstock to form a contaminated hydrocarbon feedstock blend which is thereafter separated into a vapor phase and a liquid phase by flashing in a flash/separation vessel, separating and cracking the vapor phase, and recovering cracked product. The heavy hydrocarbon feedstock allows operation of the flash/separation vessel at a higher temperature, within the operating temperature range of the separation vessel.

28 Claims, 1 Drawing Sheet

U.S. PATENT DOCUMENTS

| | | | | |
|---|---|---|---|---|
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | |
| 4,400,182 | A | 8/1983 | Davies et al. | |
| 4,426,278 | A | 1/1984 | Kosters | 208/130 |
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | |
| 5,096,567 | A | 3/1992 | Paspek, Jr. et al. | 208/106 |
| 5,120,892 | A | 6/1992 | Skraba | 585/652 |
| 5,141,906 | A | 8/1992 | Takeshima et al. | |
| 5,190,634 | A | 3/1993 | Fernandez-Baujin et al. | 208/107 |
| 5,468,367 | A | 11/1995 | Dickakian et al. | |
| 5,580,443 | A | 12/1996 | Yoshida et al. | 208/130 |
| 5,817,226 | A | 10/1998 | Lenglet | |
| 5,910,440 | A | 6/1999 | Grossman et al. | |
| 6,093,310 | A | 7/2000 | Swan | |
| 6,123,830 | A | 9/2000 | Gupta et al. | |
| 6,179,997 | B1 | 1/2001 | Vedder, Jr. et al. | 208/113 |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,376,732 | B1 | 4/2002 | Ngan et al. | |
| 6,632,351 | B1 | 10/2003 | Ngan et al. | 208/132 |
| 6,743,961 | B2 | 6/2004 | Powers | |
| 2001/0016673 | A1 | 8/2001 | Bridges et al. | |
| 2003/0070963 | A1 | 4/2003 | Zimmermann et al. | |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2004/0039240 | A1 | 2/2004 | Powers | |
| 2004/0054247 | A1 | 3/2004 | Powers | |
| 2005/0010075 | A1 | 1/2005 | Powers | |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 10/1977 |
| GB | 2 012 176 | 11/1977 |
| NL | 7410163 | 4/1975 |
| SU | 1491552 | 7/1989 |
| WO | WO 01/55280 | 8/2001 |
| WO | WO 2004/005433 | 1/2004 |
| ZA | 907394 | 7/1991 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16, 1999.

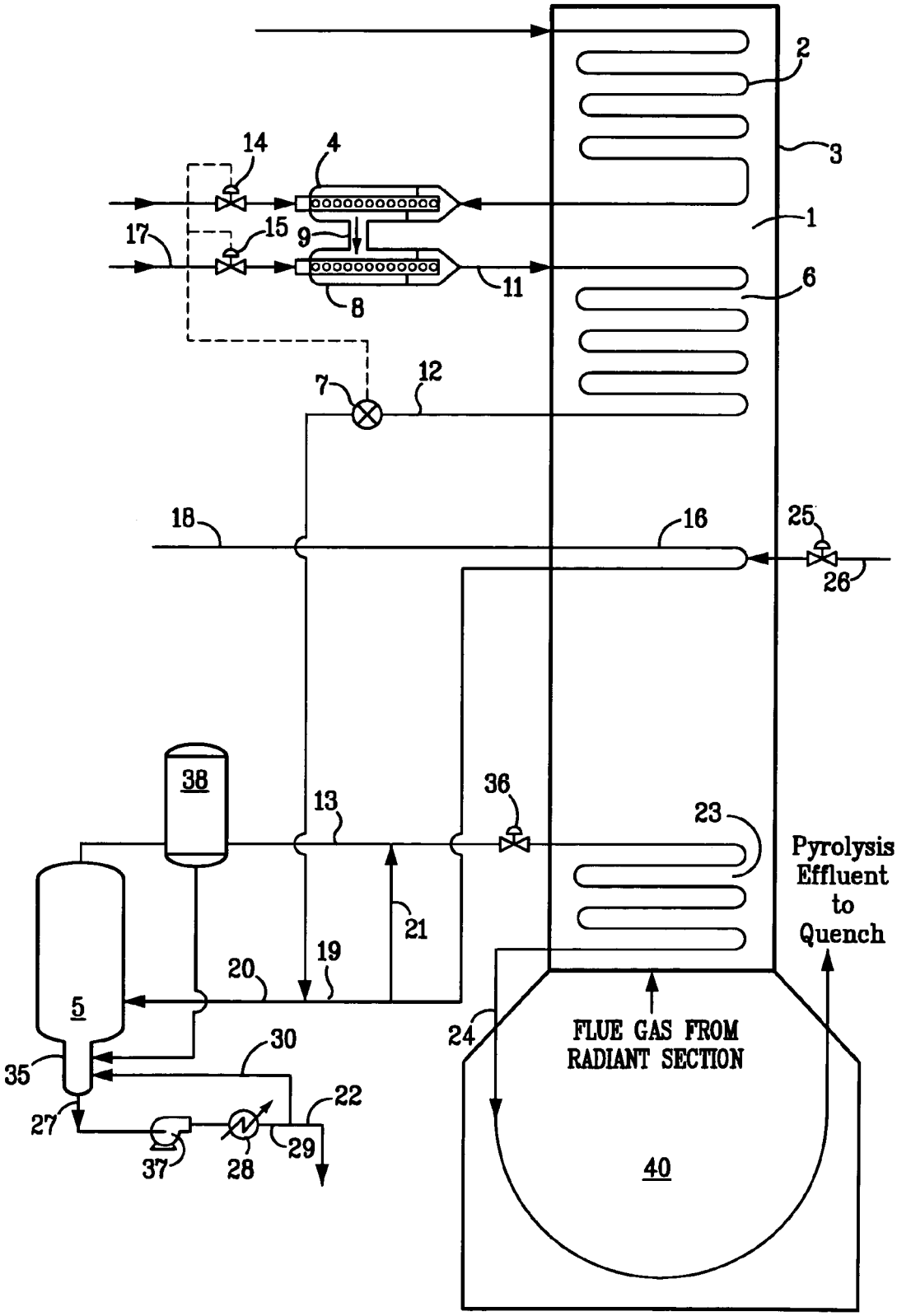
2
3
1
14
4
17
15
9
11
6
8
7
12
18
16
25
26
38
13
36
23
Pyrolysis
Effluent
to
Quench
21
19
20
5
24
FLUE GAS FROM
RADIANT SECTION
30
35
22
27
29
37
28
40

STEAM CRACKING OF LIGHT HYDROCARBON FEEDSTOCKS CONTAINING NON-VOLATILE COMPONENTS AND/OR COKE PRECURSORS

FIELD

The present invention relates to the steam cracking of light hydrocarbon feedstocks that contain relatively non-volatile components and/or coke precursors.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light low molecular weight feedstocks which enter as a vapor) wherein it is typically heated and vaporized by indirect contact with hot flue gas from the radiant section and, to a lesser extent, by direct contact with steam. The vaporized feedstock and steam mixture is then introduced into the radiant section where the cracking takes place. The resulting products including olefins leave the pyrolysis furnace for further downstream processing, including quenching.

Pyrolysis involves heating the feedstock sufficiently to cause thermal decomposition of the larger molecules. The pyrolysis process, however, produces molecules which tend to combine to form high molecular weight materials known as tar. Tar is a high-boiling point, viscous, reactive material that can foul equipment under certain conditions. In general, feedstocks containing higher boiling materials tend to produce greater quantities of tar.

The formation of tar after the pyrolysis effluent leaves the steam cracking furnace can be minimized by rapidly reducing the temperature of the effluent exiting the pyrolysis unit to a level at which the tar-forming reactions are greatly slowed. This cooling which may be achieved in one or more steps and using one or more methods is referred to as quenching.

Conventional steam cracking systems have been effective for cracking high-quality feedstock which contain a large fraction of light volatile hydrocarbons, such as gas oil and naphtha. However, steam cracking economics sometimes favor cracking lower cost heavy feedstocks such as, by way of non-limiting examples, crude oil, and atmospheric residue. Crude oil and atmospheric residue often contain high molecular weight, non-volatile components with boiling points in excess of 590° C. (1100° F.) otherwise known as asphaltenes, bitumen, or resid. The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha and gas oil crackers, cooling of the effluent from the cracking furnace is normally achieved using a system of transfer line heat exchangers, a primary fractionator, and a water quench tower or indirect condenser. The steam generated in transfer line exchangers can be used to drive large steam turbines which power the major compressors used elsewhere in the ethylene production unit.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 and 1100° F. (230 and 590° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

U.S. patent application Ser. No. 10/188,461, filed Jul. 3, 2002, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. The amount of fluid mixed with the feedstock is varied in accordance with a selected operating parameter of the process, e.g., temperature of the mixture stream before the mixture stream is flashed, the pressure of the flash, the flow rate of the mixture stream, and/or the excess oxygen in the flue gas of the furnace.

In some instances desirable hydrocarbon feedstocks such as naphthas or condensates are contaminated with non-volatile components and/or coke precursors. This contamination could occur through contact with crude or heavy hydrocarbon residue in shipping and storage equipment. It would be inefficient and expensive to re-process these feedstocks to remove the contamination, but the contamination would result in coking in any of the processes described above.

It has now surprisingly been found that the addition of a heavy hydrocarbon feedstock to the contaminated light hydrocarbon feedstock can reduce or almost eliminate the formation of coke upstream of the flash/separation vessel and/or increase the percentage of a contaminated light hydrocarbon feedstock stream available for cracking.

SUMMARY

The present invention relates to a process for cracking a light hydrocarbon feedstock containing non-volatile components and/or coke precursors. The process comprises: (a) adding a heavy hydrocarbon feedstock to the contaminated light hydrocarbon feedstock to form a contaminated hydrocarbon feedstock blend; (b) heating the contaminated hydrocarbon feedstock blend; (c) feeding the contaminated hydrocarbon feedstock blend to a flash/separation vessel; (d) separating the contaminated hydrocarbon feedstock blend into a non-volatile component and coke precursor depleted vapor phase and a liquid phase rich in non-volatile components and/or coke precursors; (e) removing the vapor phase from the flash/separation vessel; (f) cracking the vapor phase in a radiant section of a pyrolysis furnace to produce an effluent comprising olefins, the pyrolysis furnace comprising a radiant section and a convection section. Steam, which may optionally comprise sour or treated process steam and may optionally be superheated, may be added at any step or steps in the process prior to cracking the vapor phase.

The addition of heavy hydrocarbon feedstock reduces the coking rate in and upstream of said flash/separation vessel and/or increases the percentage of the light hydrocarbon available in the vapor phase for cracking as compared to using a feedstock comprising only the contaminated light hydrocarbon feedstock containing non-volatile components and/or coke precursors. The addition of heavy hydrocarbon feedstock would generally increase the $T_{98}$ of the contaminated hydrocarbon feedstock blend by at least about 28° C. (about 50° F.) from the $T_{98}$ of the contaminated light hydrocarbon feedstock, for example by at least about 56° C. (about 100° F.). Preferably the addition of heavy hydrocarbon feedstock also increases the $T_{95}$ of the contaminated hydrocarbon feedstock blend by at least about 14° C. (about 25° F.) from the $T_{95}$ of the contaminated light hydrocarbon feedstock, for example by at least about 28° C. (about 50° F.).

The heavy hydrocarbon feedstock generally comprises between about 2 wt. % and about 75 wt. % of the contaminated hydrocarbon feedstock blend, for example between about 5 wt. % and about 60 wt. % of the contaminated hydrocarbon feedstock blend, such as between about 10 wt. % and about 50 wt. % of the contaminated hydrocarbon feedstock blend.

Preferably, the contaminated hydrocarbon feedstock blend with non-volatile components and/or coke precursors is heated by indirect contact with flue gas in a first convection section tube bank of the pyrolysis furnace, for example to about 150 to about 340° C. (about 300 to about 650° F.), before optionally mixing with a primary dilution steam stream. The contaminated hydrocarbon feedstock blend may also be mixed with a fluid, such as hydrocarbon or water, in addition to the primary dilution steam stream. The preferred fluid is water.

The contaminated hydrocarbon feedstock blend may be further heated by indirect contact with flue gas in a second convection section tube bank of the pyrolysis furnace before being flashed. Preferably, the temperature of the contaminated hydrocarbon feedstock blend in step (c) is from about 315 to about 560° C. (about 600 to about 1040° F.). Preferably the separation in step (d) is at a pressure of from about 275 to about 1380 kPa (about 40 to about 200 psia). Generally, about 50 to about 98 percent of the contaminated hydrocarbon feedstock blend is in the vapor phase after being flashed. Additionally, steam may be added to the vapor phase in the top portion of the flash/separation vessel or downstream of the flash/separation vessel.

If desired, the vapor phase may be sent through an additional separation step to remove trace amounts of liquid before step (f). The preferred vapor phase temperature entering the radiant section of the pyrolysis furnace is from about 425 to about 705° C. (about 800 to about 1300° F.), which may optionally be attained by additional heating in a convection section tube bank, preferably the bank nearest the radiant section of the furnace.

BRIEF DESCRIPTION OF THE DRAWINGS

FIG. 1 illustrates a schematic flow diagram of the overall process and apparatus in accordance with the present invention employed with a pyrolysis furnace.

DETAILED DESCRIPTION

Unless otherwise stated, all percentages, parts, ratios, etc. are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, non-volatile components are the fraction of a hydrocarbon stream with a nominal boiling point above 590° C. (1100° F.) as measured by ASTM D-6352-98 or D-2887. This invention works very well with non-volatile components having a nominal boiling point above 760° C. (1400° F.). The boiling point distribution of the hydrocarbon stream is measured by Gas Chromatograph Distillation (GCD) according to the methods described in ASTM D-6352-98 or D-2887, extended by extrapolation for materials boiling above 700° C. (1292° F.). Non-volatile components can include coke precursors, which are moderately heavy and/or reactive molecules, such as multi-ring aromatic compounds, which can condense from the vapor phase and then form coke under the operating conditions encountered in the present process of the invention. $T_{50}$ as used herein shall mean the temperature, determined according to the boiling point distribution described above, at which 50 weight percent of a particular sample has reached its boiling point. Likewise $T_{95}$ or $T_{98}$ mean the temperature at which 95 or 98 weight percent of a particular sample has reached its boiling point. Nominal final boiling point shall mean the temperature at which 99.5 weight percent of a particular sample has reached its boiling point.

The light hydrocarbon feedstock for use in the present invention typically comprises one or more of gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, wide boiling range naphtha to gas oil condensates, and heavy gas oil; and further comprises non-volatile components and/or coke precursors.

The heavy hydrocarbon feedstock for use with the present invention typically comprises one or more of steam cracked gas oil and residues, crude oil, atmospheric pipestill bottoms, vacuum pipestill streams including bottoms, heavy non-virgin hydrocarbon streams from refineries, vacuum gas oils, low sulfur waxy residue, atmospheric residue, and heavy residue. One preferred heavy hydrocarbon feedstock is an economically advantaged, minimally processed heavy hydrocarbon stream containing non-volatile hydrocarbons and/or coke precursors. Another preferred heavy hydrocarbon feedstock for use in this invention is an atmospheric pipestill bottoms stream.

The heavy hydrocarbon feedstock will preferably have a higher $T_{50}$ boiling point than the light hydrocarbon feedstock, but may have a nominal final boiling point below, equal to, or greater than the nominal final boiling point of the light hydrocarbon feedstock. Likewise the initial boiling point of the heavy hydrocarbon feedstock may be lower than, equal to, or greater than the initial boiling point of the light hydrocarbon feedstock, but will generally be at least about 56° C. (about 100° F.) higher, more typically at least about 280° C. (about 500° F.), and often more than about 390° C. (about 700° F.) higher.

Preferably, the addition of the heavy hydrocarbon feedstock will result in a contaminated hydrocarbon feedstock blend with a $T_{98}$ boiling point at least about 28° C. (about 50° F.) higher than the $T_{98}$ boiling point of the light hydrocarbon feedstock, for example at least about 56° C. (about 100° F.) higher, as a further example at least about 111° C. (about 200° F.) higher, and as yet another example at least about 167° C. (about 300° F.) higher. Preferably, the addition of the heavy hydrocarbon feedstock will also result in a contaminated hydrocarbon feedstock blend with a $T_{95}$ boiling point at least about 14° C. (about 25° F.) higher than the $T_{95}$ boiling point of the light hydrocarbon feedstock, such as at least about 28° C. (about 50° F.) for example at least about 56° C. (about 100° F.) higher, as a further example at least about 111° C. (about 200° F.) higher, and as yet another example at least about 167° C. (about 300° F.) higher.

Vapor-liquid equilibrium modeling using computer software, such as PROvision™ by Simulation Sciences Inc., can be used to determine optimal quantities of a given heavy hydrocarbon feedstock for use with a given contaminated light hydrocarbon feedstock.

The present invention relates to a process for heating and steam cracking a light hydrocarbon feedstock containing non-volatile hydrocarbons. The process comprises mixing a heavy hydrocarbon feedstock with a contaminated light hydrocarbon feedstock to form a contaminated hydrocarbon feedstock blend, heating the contaminated hydrocarbon feedstock blend, flashing the contaminated hydrocarbon feedstock blend to form a vapor phase and a liquid phase, feeding the vapor phase to the radiant section of a pyrolysis furnace, and producing an effluent comprising olefins.

The addition of steam at various points is disclosed elsewhere and will, for simplicity, not be detailed in every description herein. It is further noted that any of the steam added may comprise sour steam or treated process steam and that any of the steam added, whether sour or not, may be superheated. Superheating is preferable when the steam comprises sour steam. Since steam and other fluids may be added at various points, the description herein will use the term "contaminated hydrocarbon feedstock blend" to mean the components of the contaminated light hydrocarbon feedstock and the heavy hydrocarbon feedstock together as they travel through the process regardless of what quantities of steam and other fluids may also be present at any given stage.

When light hydrocarbon feedstock having essentially no non-volatile components and/or coke precursors is cracked, the feed is typically preheated in the upper convection section of a pyrolysis furnace, optionally mixed with steam, and then further preheated in the convection section, where essentially all of the light hydrocarbon feedstock vaporizes forming a vapor phase which is the fed to the radiant section of the furnace for pyrolysis. Contamination of the light hydrocarbon feedstock with non-volatile components and/or coke precursors would, however, result in extensive coke formation in the convection tubes in that process. This concern was partially addressed in U.S. Pat. No. 5,580,443, which discloses a process wherein the feedstock is first preheated, then withdrawn from a preheater in the convection section of the pyrolysis furnace, mixed with a predetermined amount of steam, introduced into a gas-liquid separator to separate and remove a required proportion of the non-volatiles as liquid from the separator. The separated vapor from the gas-liquid separator is returned to the pyrolysis furnace for heating and cracking.

In order to prevent coking in the convection tubes just upstream of the separator and the separator itself due to relatively small volumes of non-volatile components and coke precursors likely to be present as a result of contamination or delivery of off-spec feedstock, the separator must be operated at a temperature sufficiently low to maintain liquid wetted surfaces and a liquid fraction of about 2 to about 50%. This liquid fraction represents an inefficient use of feedstock as it contains light hydrocarbons that could economically have been cracked to form additional olefins product.

Rather than cracking a contaminated light hydrocarbon feedstock as it is delivered, it has surprisingly been found to be advantageous to blend the contaminated light hydrocarbon feedstock with a quantity of a heavy hydrocarbon feedstock. Multiple synergistic effects can be realized with such a procedure.

It will be recognized that economic considerations would generally favor maximizing the fraction of the feedstock which is in the vapor phase and subsequently cracked. One of the benefits which can be realized by the addition of a heavy hydrocarbon feedstock to the contaminated light hydrocarbon feedstock is an increase in the percentage of the light hydrocarbon feedstock vaporized along with some fraction of the heavy hydrocarbon feedstock while coking is reduced or essentially eliminated. Assuming the contaminants present accounted for less than about 0.5% of the light hydrocarbon feedstock, the difference in vaporized volume of light hydrocarbon feedstock could be at least about 1%, for example at least about 2%, such as at least about 5%. The process of the present invention allows the loss of light hydrocarbon, exclusive of contaminants, in the liquid phase leaving a flash/separation vessel to be reduced to negligible quantities. In addition, depending on the heavy hydrocarbon feedstock used, a fraction of the heavy hydrocarbon feedstock will be vaporized and subsequently available for cracking.

The heavy hydrocarbon feedstock added to the contaminated light hydrocarbon feedstock may be from about 2 to about 75 percent of the resultant contaminated hydrocarbon feedstock blend stream, for example from about 5% to about 60%, and as a further example from about 10% to about 50%. The percentage of the heavy hydrocarbon feedstock added to the contaminated light hydrocarbon feedstock will be optimized according to economics and availability of given hydrocarbon streams at any particular time. The quantity of heavy hydrocarbon feedstock added is desirably sufficient to result in a liquid fraction of at least about 2% of the total flow into the flash/separation vessel, and generally in the range of about 2 to about 50%. It is noted that the lighter the heavy hydrocarbon feedstock is relative to the contaminated light hydrocarbon feedstock being used, the more heavy hydrocarbon feedstock will be required for optimal benefit. For example, if the flash/separation vessel were operated at about 370° C. (about 700° F.), about 20% of vacuum residue added to a contaminated condensate might result in about 2% liquid phase in the flash/separation vessel and about 40% of a lighter atmospheric residue might be required to maintain the liquid phase at greater than about 2%.

Depending on tankage available, the heavy hydrocarbon feedstock may be added to the contaminated light hydrocarbon feedstock in the feedstock storage tanks or at any point prior to introduction of the contaminated hydrocarbon feedstock blend to the convection section of the furnace. Preferably, both the heavy hydrocarbon feedstock and the light hydrocarbon feedstock are at a sufficient temperature to ensure flowability of both the heavy hydrocarbon feedstock and the blended feedstock upon mixing.

After blending the heavy hydrocarbon feedstock with a contaminated light hydrocarbon feedstock to produce a contaminated hydrocarbon feedstock blend, the heating of the contaminated hydrocarbon feedstock blend can take any form known by those of ordinary skill in the art. However, it is preferred that the heating comprises indirect contact of the contaminated hydrocarbon feedstock blend in the upper (farthest from the radiant section) convection section tube bank 2 of the furnace 1 with hot flue gases from the radiant section of the furnace. This can be accomplished, by way of non-limiting example, by passing the contaminated hydrocarbon feedstock blend through a bank of heat exchange tubes 2 located within the convection section 3 of the furnace 1. The heated contaminated hydrocarbon feedstock blend typically has a temperature between about 150 and about 340° C. (about 300 and about 650° F.), such as about 160 to about 230° C. (about 325 to about 450° F.), for example about 170 to about 220° C. (about 340 to about 425° F.).

The heated contaminated hydrocarbon feedstock blend may be mixed with primary dilution steam and, optionally, a fluid which can be a hydrocarbon, preferably liquid but optionally vapor; water; steam; or a mixture thereof. The preferred fluid is water. A source of the fluid can be low pressure boiler feed water. The temperature of the fluid can be below, equal to, or above the temperature of the heated feedstock. In one possible embodiment, the fluid latent heat of vaporization can be used to control the contaminated hydrocarbon feedstock blend temperature entering the flash/separation vessel.

The mixing of the heated contaminated hydrocarbon feedstock blend, primary dilution steam, and the optional fluid can occur inside or outside the pyrolysis furnace 1, but preferably it occurs outside the furnace. The mixing can be accomplished using any mixing device known within the art. For example, it is possible to use a first sparger 4 of a double sparger assembly 9 for the mixing. The first sparger 4 can avoid or reduce hammering, caused by sudden vaporization of the fluid, upon introduction of the fluid into the heated hydrocarbon feedstock.

The use of steam and or fluid mixed with the contaminated hydrocarbon feedstock blend is optional for high volatility feedstocks such as the light hydrocarbon feedstock used in the process of this invention. It is possible that such feedstocks can be heated in any manner known in the industry, for example in heat exchange tubes 2 located within the convection section 3 of the furnace 1. The contaminated hydrocarbon feedstock blend could be conveyed to the flash/separation vessel with little or no added steam or fluid.

The primary dilution steam 17 can have a temperature greater, lower or about the same as contaminated hydrocarbon feedstock blend fluid mixture but preferably the temperature is about the same as that of the mixture. The primary dilution steam may be superheated before being injected into the second sparger 8.

The mixture stream comprising the heated contaminated hydrocarbon feedstock blend, the fluid, and the optional primary dilution steam stream leaving the second sparger 8 is optionally heated further in the convection section of the pyrolysis furnace 3 before the flash. The heating can be accomplished, by way of non-limiting example, by passing the mixture stream through a bank of heat exchange tubes 6 located within the convection section, usually as a lower part of the first convection section tube bank, of the furnace and thus heated by the hot flue gas from the radiant section of the furnace. The thus-heated contaminated hydrocarbon feedstock blend leaves the convection section as part of a mixture stream 12 to optionally be further mixed with an additional steam stream.

Optionally, the secondary dilution steam stream 18 can be further split into a flash steam stream 19 which is mixed with the hydrocarbon mixture 12 before the flash and a bypass steam stream 21 which bypasses the flash of the hydrocarbon mixture and, instead is mixed with the vapor phase from the flash before the vapor phase is further heated in the lower convection section and then cracked in the radiant section of the furnace. The present invention can operate with all secondary dilution steam 18 used as flash steam 19 with no bypass steam 21. Alternatively, the present invention can be operated with secondary dilution steam 18 directed to bypass steam 21 with no flash steam 19. In a preferred embodiment in accordance with the present invention, the ratio of the flash steam stream 19 to bypass steam stream 21 should be preferably 1:20 to 20:1, and most preferably 1:2 to 2:1. In this embodiment, the flash steam 19 is mixed with the hydrocarbon mixture stream 12 to form a flash stream 20 before the flash in flash/separation vessel 5. Preferably, the secondary dilution steam stream is superheated in a superheater section 16 in the furnace convection before splitting and mixing with the hydrocarbon mixture. The addition of the flash steam stream 19 to the hydrocarbon mixture stream 12 aids the vaporization of less volatile components of the mixture before the flash stream 20 enters the flash/separation vessel 5.

A second optional fluid can be added to the mixture stream before flashing the mixture stream, the second fluid being a hydrocarbon vapor.

The mixture stream 12 or the flash stream 20 is then flashed, for example in a flash/separation vessel 5, for separation into two phases: a vapor phase comprising predominantly light hydrocarbon feedstock, volatile hydrocarbons from the heavy hydrocarbon feedstock, and steam and a liquid phase comprising less-volatile hydrocarbons along with a significant fraction of the non-volatile components and/or coke precursors. It is understood that vapor-liquid equilibrium at the operating conditions described herein would result in very small quantities of non-volatile components and/or coke precursors present in the vapor phase. Additionally, and varying with the design of the flash/separation vessel, minute quantities of liquid containing non-volatile components and/or coke precursors could be entrained in the vapor phase. In the process of this invention, these quantities are sufficiently small to allow decoking downstream of the flash/separation vessel on the same schedule as for decoking in the radiant section of the furnace. The vapor phase can be considered to have substantially no non-volatile components or coke precursors when coke buildup in the convection section between the flash/separation vessel is at a sufficiently low rate that decoking is not required any more frequently than decoking of the radiant section is required.

For ease of description herein, the term flash/separation vessel will be used to mean any vessel or vessels used to separate the contaminated hydrocarbon feedstock blend into a vapor phase and at least one liquid phase. It is intended to include fractionation and any other method of separation, for example, but not limited to, drums, distillation towers, and centrifugal separators.

The mixture stream 12 is preferably introduced tangentially to the flash/separation vessel 5 through at least one side inlet located in the side of said vessel. The vapor phase is preferably removed from the flash/separation vessel as an overhead vapor stream 13. The vapor phase, preferably, is fed back to a convection section tube bank 23 of the furnace, preferably located nearest the radiant section of the furnace, for optional heating and through crossover pipes 24 to the radiant section 40 of the pyrolysis furnace for cracking. The liquid phase of the flashed mixture stream is removed from the flash/separation vessel 5, preferably as a bottoms stream 27.

It is preferred to maintain a predetermined constant ratio of vapor to liquid in the flash/separation vessel 5, but such ratio is difficult to measure and control. As an alternative, temperature of the mixture stream 12 before the flash/separation vessel 5 can be used as an indirect parameter to measure, control, and maintain an approximately constant vapor to liquid ratio in the flash/separation vessel 5. Ideally, when the mixture stream temperature is higher, more volatile hydrocarbons will be vaporized and become available, as part of the vapor phase, for cracking. However, when the mixture stream temperature is too high, more heavy hydrocarbons, including coke precursors, will be present in the vapor phase and carried over to the convection furnace tubes, eventually coking the tubes. If the mixture stream 12 temperature is too low, resulting in a low ratio of vapor to liquid in the flash/separation vessel 5, more volatile hydrocarbons will remain in liquid phase and thus will not be available for cracking.

The mixture stream temperature is controlled to maximize recovery or vaporization of volatiles in the feedstock while avoiding excessive coking in the furnace tubes or coking in piping and vessels conveying the mixture from the flash/separation vessel to the furnace 1 via line 13. The pressure drop across the piping and vessels 13 conveying the mixture to the lower convection section 23, and the crossover piping 24, and the temperature rise across the lower convection section 23 may be monitored to detect the onset of coking problems. For instance, if the crossover pressure and process inlet pressure to the lower convection section 23 begin to increase rapidly due to coking, the temperature in the flash/separation vessel 5 and the mixture stream 12 should be reduced. If coking occurs in the lower convection section, the temperature of the flue gas to the higher sections, such as the optional superheater 16, increases. If a superheater 16 is present, the increased flue gas temperature can be offset in part by adding more desuperheater water 26.

The selection of the mixture stream 12 temperature is also determined by the composition of the feedstock materials. When the feedstock contains higher amounts of lighter hydrocarbons, the temperature of the mixture stream 12 can be set lower. When the feedstock contains a higher amount of less- or non-volatile hydrocarbons, the temperature of the mixture stream 12 should be set higher.

Typically, the temperature of the mixture stream 12 can be set and controlled at between about 315 and about 540° C. (about 600 and about 1000° F.), such as between about 370 and about 510° C. (about 700 and about 950° F.), for example between about 400 and about 480° C. (about 750 and about 900° F.), and often between about 430 and about 475° C. (about 810 and about 890° F.). These values will change with the volatility of the feedstock as discussed above.

Considerations in determining the temperature include the desire to maintain a liquid phase to reduce or eliminate the likelihood of coke formation in the flash/separation vessel and associated piping and on convection tubes upstream of the flash/separation vessel. Typically, at least about 2 percent of the total hydrocarbons are the liquid phase after being flashed.

It is desirable to maintain a constant temperature for the mixture stream 12 mixing with flash steam 19 and entering the flash/separation vessel to achieve a constant ratio of vapor to liquid in the flash/separation vessel 5, and to avoid substantial temperature and flash vapor to liquid ratio variations. One possible control arrangement is the use of a control system 7 to automatically control the fluid valve 14 and primary dilution steam valve 15 on the two spargers to maintain a set temperature for the mixture stream 12 before the flash/separation vessel 5. When the control system 7 detects a drop of temperature of the mixture stream, it will cause the fluid valve 14 to reduce the injection of the fluid into the first sparger 4. If the temperature of the mixture stream starts to rise, the fluid valve will be opened wider to increase the injection of the fluid into the first sparger 4.

When the primary dilution steam stream 17 is injected to the second sparger 8, the temperature control system 7 can also be used to control the primary dilution steam valve 15 to adjust the amount of primary dilution steam stream injected to the second sparger 8. This further reduces the sharp variation of temperature changes in the flash 5. When the control system 7 detects a drop of temperature of the mixture stream 12, it will instruct the primary dilution steam valve 15 to increase the injection of the primary dilution steam stream into the second sparger 8 while valve 14 is closed more. If the temperature starts to rise, the primary dilution steam valve will automatically close more to reduce the primary dilution steam stream injected into the second sparger 8 while valve 14 is opened wider.

In an example embodiment where the fluid is water, the controller varies the amount of water and primary dilution steam to maintain a constant mixture stream temperature 12, while maintaining a constant ratio of $H_2O$ to feedstock in the mixture 11. To further avoid sharp variation of the flash temperature, the present invention also preferably utilizes an intermediate desuperheater 25 in the superheating section of the secondary dilution steam in the furnace. This allows the superheater 16 outlet temperature to be controlled at a constant value, independent of furnace load changes, coking extent changes, excess oxygen level changes, and other variables. Normally, this desuperheater 25 maintains the temperature of the secondary dilution steam between about 425 and about 590° C. (about 800 and about 1100° F.), for example between about 455 and about 540° C. (about 850 and about 1000° F.), such as between about 455 and about 510° C. (about 850 and about 950° F.). The desuperheater can be a control valve and water atomizer nozzle. After partial preheating, the secondary dilution steam exits the convection section and a fine mist of desuperheater water 26 can be added which rapidly vaporizes and reduces the temperature. The steam is preferably then further heated in the convection section. The amount of water added to the superheater can control the temperature of the steam which is mixed with mixture stream 12.

In addition to maintaining a constant temperature of the mixture stream 12 entering the flash/separation vessel, it is generally also desirable to maintain a constant hydrocarbon partial pressure of the flash stream 20 in order to maintain a constant ratio of vapor to liquid in the flash/separation vessel. By way of examples, the constant hydrocarbon partial pressure can be maintained by maintaining constant flash/separation vessel pressure through the use of control valves 36 on the vapor phase line 13, and by controlling the ratio of steam to contaminated hydrocarbon feedstock blend in stream 20.

Typically, the hydrocarbon partial pressure of the flash stream in the present invention is set and controlled at between about 25 and about 175 kPa (about 4 and about 25 psia), such as between about 35 and about 100 kPa (about 5 and about 15 psia), for example between about 40 and about 75 kPa (about 6 and about 11 psia).

In one embodiment, the flash is conducted in at least one flash/separation vessel. Typically the flash is a one-stage process with or without reflux. The flash/separation vessel 5 is normally operated at about 275 to about 1400 kPa (about 40 to about 200 psia) pressure and its temperature is usually the same or slightly lower than the temperature of the flash stream 20 before entering the flash/separation vessel 5. Typically, the pressure at which the flash/separation vessel operates is about 275 to about 1400 kPa (about 40 to about 200 psia), for example about 600 to about 1100 kPa (about 85 to about 155 psia), as a further example about 700 to about 1000 kPa (about 105 to about 145 psia), and in yet another example, the pressure of the flash/separation vessel can be about 700 to about 760 kPa (about 105 to about 125 psia). The temperature at which the flash/separation vessel operates, or the temperature of the inlet stream to the flash/separation vessel, is about 315 to about 560° C. (about 600 to about 1040° F.), such as about 370 to about 490° C. (about 700 to about 920° F.), for example about 400 to about 480° C. (about 750 to about 900° F.). Depending on the temperature of the mixture stream 12, generally about 50 to about 98% of the mixture stream being flashed is in the vapor phase, such as about 70 to about 95%.

The flash/separation vessel 5 is generally operated, in one aspect, to minimize the temperature of the liquid phase at the bottom of the vessel because too much heat may cause coking of the non-volatiles in the liquid phase. It may also be helpful to recycle a portion of the externally cooled flash/separation vessel bottoms liquid 30 back to the flash/separation vessel to help cool the newly separated liquid phase at the bottom of the flash/separation vessel 5. Stream 27 can be conveyed from the bottom of the flash/separation vessel 5 to the cooler 28 via pump 37. The cooled stream 29 can then be split into a recycle stream 30 and export stream 22. The temperature of the recycled stream would typically be about 260 to about 315° C. (about 500 to about 600° F.), for example about 270 to about 290° C. (about 520 to about 550° F.). The amount of recycled stream can be about 80 to about 250% of the amount of the newly separated bottom liquid inside the flash/separation vessel, such as about 90 to about 225%, for example about 100 to about 200%.

The flash is generally also operated, in another aspect, to minimize, the liquid retention/holding time in the flash vessel. In one example embodiment, the liquid phase is discharged from the vessel through a small diameter "boot" or cylinder 35 on the bottom of the flash/separation vessel. Typically, the liquid phase retention time in the flash/separation vessel is less than 75 seconds, for example less than 60 seconds, such as less than 30 seconds, and often less than 15 seconds. The shorter the liquid phase retention/holding time in the flash/separation vessel, the less coking occurs in the bottom of the flash/separation vessel.

The vapor phase leaving the flash/separation vessel may contain, for example, about 55 to about 70% hydrocarbons and about 30 to about 45% steam. The nominal boiling end point of the vapor phase is normally below about 760° C. (about 1400° F.), such as below about 590° C. (about 1100° F.), for example below about 565° C. (about 1050° F.), and often below about 540° C. (about 1000° F.). The vapor phase is continuously removed from the flash/separation vessel 5 through an overhead pipe, which optionally conveys the vapor to an optional centrifugal separator 38 to remove trace amounts of entrained and/or condensed liquid. The vapor then typically flows into a manifold that distributes the flow to the convection or radiant section of the furnace.

vapor phase stream 13 continuously removed from the flash/separation vessel is preferably superheated in the pyrolysis furnace lower convection section 23 to a temperature of, for example, about 425 to about 705° C. (about 800 to about about 1300° F.) by the flue gas from the radiant section of the furnace. The vapor phase is then introduced to the radiant section of the pyrolysis furnace to be cracked to produce an effluent comprising olefins, including ethylene and other desired light olefins, and byproducts.

The vapor phase stream 13 removed from the flash/separation vessel can optionally be mixed with a bypass steam stream 21 before being introduced into the furnace lower convection section 23.

Because the process of this invention results in significant removal of the coke- and tar-producing heavier hydrocarbon species (in the liquid phase 27 leaving the flash/separation vessel 5), it may be possible to utilize a transfer line, exchanger for quenching the effluent from the radiant section of the pyrolysis furnace. Among other benefits, this will allow more cost-effective retrofitting of cracking facilities initially designed for lighter (uncontaminated) feeds, such as naphthas, or other liquid feedstocks with end boiling points generally below about 315° C. (about 600° F.), which have transfer line exchanger quench systems already in place. Co-pending Provisional Application Ser. No. 60/555,282, filed Mar. 22, 2004, details a design for maximizing the benefits associated with use of a transfer line exchanger in conjunction with a process for cracking hydrocarbon feedstocks comprising non-volatile components.

The location and operating temperature of the flash/separation vessel is selected to provide the maximum possible vapor feed which can be processed without excessive fouling/coking concerns. If the ratio of liquid is too high, valuable feed will be lost and the economics of the operation will be detrimentally affected. If the ratio of liquid is too low, coking precursors from the heavy ends of the hydrocarbon feed stream can enter the high temperature sections of the furnace and cause accelerated coking leading to unacceptably frequent decoking operations.

The percentage of given hydrocarbon feed discharged from the flash/separation vessel as a vapor is a function of the hydrocarbon partial pressure in the flash/separation vessel and of the temperature entering the vessel. The temperature of the contaminated hydrocarbon feedstock blend entering the flash/separation vessel is highly dependent on the flue-gas temperature at that point in the convection section. This temperature will vary as the furnace load is changed, being higher when the furnace is at full load, and lower when the furnace is at partial load. The flue-gas temperature in the first convection section tube bank is also a function of the extent of coking that has occurred in the furnace. When the furnace is clean or lightly coked, heat transfer is improved and the flue-gas temperature at that point is correspondingly cooler than when the furnace is heavily coked. The flue-gas temperature at any point is also a function of the combustion control exercised on the burners of the furnace. When the furnace is operated with low levels of excess oxygen in the flue-gas the flue-gas temperature at any point will be correspondingly lower than when the furnace is operated with higher levels of excess oxygen in the flue-gas.

Total furnace load is determined by the heat requirements for pyrolysis in the radiant section of the furnace as well as heat requirements in the convection section. Excess oxygen above about 2% is in essence a reflection of extra air volumes being heated in the radiant section of the furnace to provide for the heat needed in the convection section. Pyrolysis capacity is limited by the heat output capabilities of the furnace and efficiency with which that heat is utilized. The ultimate limitation on furnace capacity is the flue gas volume, therefore minimizing the excess oxygen (with the accompanying nitrogen) allows greater capacity for heat generation. Improved heat transfer in both the radiant and convection sections achieved by reducing coke formation will allow total pyrolysis throughput to be increased.

The total energy requirement in the convection section is the sum of the energy required to vaporize the hydrocarbon stream to a desired cutpoint, vaporize and superheat any water used for flash temperature control, superheat the hydrocarbon vapor, and superheat the dilution steam.

One potential source of the heavy hydrocarbon feedstock used in the process of this invention is the bottoms stream from a flash/separation vessel, either recycled from the same flash/separation vessel or from another process train. An advantage of using a bottoms stream from a flash/separation vessel is that a smaller volume of this liquid would be required, reducing pumping requirements, because a higher percentage of this heavy hydrocarbon feedstock would be expected to remain in the liquid phase. While readily available, this source of heavy hydrocarbon feedstock may not provide any significant addition to vapor phase quantities.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for cracking a contaminated light hydrocarbon feedstock, said contaminated light hydrocarbon feedstock comprising non-volatile components and/or coke precursors and said process comprising:

a. mixing a heavy hydrocarbon feedstock with said contaminated light hydrocarbon feedstock to form a contaminated hydrocarbon feedstock blend;

b. heating said contaminated hydrocarbon feedstock blend;

c. feeding the contaminated hydrocarbon feedstock blend to a flash/separation vessel;

d. separating the contaminated hydrocarbon feedstock blend into a vapor phase and a liquid phase, said liquid phase being rich in non-volatile components and/or coke precursors and said vapor phase being substantially depleted of non-volatile components and/or coke precursors;

e. removing the vapor phase from the flash/separation vessel; and f. cracking the vapor phase in a radiant section of a pyrolysis furnace to produce an effluent comprising olefins, said pyrolysis furnace comprising a radiant section and a convection section wherein the volume of said heavy hydrocarbon feedstock is sufficient to reduce the coking rate in and upstream of said flash/separation vessel as compared to using a feedstock comprising only the contaminated light hydrocarbon feedstock at the same operating conditions.

2. The process of claim 1 wherein steam is added at any step or steps prior to step (f).

3. The process of claim 2, wherein the steam comprises sour or treated process steam.

4. The process of claim 2, wherein the steam is superheated in the convection section of the pyrolysis furnace.

5. The process of claim 2, wherein steam is added between steps (b) and (c).

6. The process of claim 2, wherein steam is added between steps (b) and (c) and the temperature of the contaminated hydrocarbon feedstock blend is at a first temperature from about 150 to about 340° C. (about 300 to about 650° F.) before mixing with the steam and the contaminated hydrocarbon feedstock blend is then further heated to a second temperature higher than the first temperature before step(c).

7. The process of claim 2, wherein steam is added to the vapor phase in the top portion of the flash/separation vessel.

8. The process of claim 2, wherein steam is added to the vapor phase downstream of the flash/separation vessel.

9. The process of claim 2, wherein the contaminated hydrocarbon feedstock blend is mixed with a fluid in addition to steam prior to step (d).

10. The process of claim 9, wherein the fluid comprises at least one of hydrocarbon and water.

11. The process of claim 10, wherein the fluid is water.

12. The process of claim 1 wherein said heavy hydrocarbon feedstock increases the $T_{98}$ of the contaminated hydrocarbon feedstock blend by at least about 28° C. (about 50° F.) from the $T_{98}$ of the contaminated light hydrocarbon feedstock.

13. The process of claim 1 wherein said heavy hydrocarbon feedstock increases the $T_{95}$ of the contaminated hydrocarbon feedstock blend by at least about 14° C. (about 25° F.) from the $T_{95}$ of the contaminated light hydrocarbon feedstock.

14. The process of claim 1 wherein said heavy hydrocarbon feedstock comprises between about 2 and about 75 wt. % of the contaminated hydrocarbon feedstock blend.

15. The process of claim 1, wherein the heavy hydrocarbon feedstock comprises one or more of residues, crude oil, atmospheric pipestill bottoms, vacuum pipestill streams including bottoms, heavy non-virgin hydrocarbon streams from refineries, vacuum gas oils, atmospheric residue, low sulfur waxy residue, and heavy residue.

16. The process of claim 1, wherein the contaminated light hydrocarbon feedstock comprises one or more of gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, wide boiling range naphtha to gas oil condensates, and heavy gas oil; and further comprises non-volatile components and/or coke precursors.

17. The process of claim 1 wherein the heavy hydrocarbon feedstock further comprises non-volatile components and/or coke precursors.

18. The process of claim 1 wherein step (c) comprises introducing the contaminated hydrocarbon feedstock blend tangentially to the flash/separation vessel through at least one side inlet located in the side of said flash/separation vessel.

19. The process of claim 1, wherein the contaminated hydrocarbon feedstock blend is heated by indirect contact with flue gas in a first convection section tube bank of the pyrolysis furnace before mixing with steam.

20. The process of claim 1, wherein the contaminated hydrocarbon feedstock blend is heated by indirect contact with flue gas in a second convection section tube bank of the pyrolysis furnace before step (c).

21. The process of claim 1, wherein the temperature of the contaminated hydrocarbon feedstock blend in step (c) is from about 315 to about 560° C. (about 600 to about 1040° F.).

22. The process of claim 1, wherein the pressure in step (d) is from about 275 to about 1380 kPa (about 40 to about 200 psia).

23. The process of claim 1, wherein about 50 to about 98 percent of the contaminated hydrocarbon feedstock blend is in the vapor phase in step (e).

24. The process of claim 1, further comprising conveying the vapor phase to a centrifugal separator to remove trace amounts of liquid before step (f).

25. The process of claim 1, wherein the vapor phase temperature entering the radiant section of the pyrolysis furnace is from about 425 to about 705° C. (about 800 to about 1300° F.).

26. The process of claim 1 further comprising quenching the effluent and recovering cracked product therefrom.

27. A process for cracking a contaminated light hydrocarbon feedstock, said contaminated light hydrocarbon feedstock comprising non-volatile components and said process comprising:

a. mixing a heavy hydrocarbon feedstock with said contaminated light hydrocarbon feedstock to form a contaminated hydrocarbon feedstock blend having a $T_{98}$ at least about 28° C. (about 50° F.) higher than the $T_{98}$ of the contaminated light hydrocarbon feedstock;

b. heating said contaminated hydrocarbon feedstock blend to a first temperature;

c. adding steam to the contaminated hydrocarbon feedstock blend;

d. further heating the contaminated hydrocarbon feedstock blend to a second temperature greater than the first temperature;

e. feeding the contaminated hydrocarbon feedstock blend to a flash/separation vessel;

f. separating the contaminated hydrocarbon feedstock blend into a vapor phase and a liquid phase, said liquid phase being rich in non-volatile components and/or coke precursors and said vapor phase being substantially depleted of non-volatile components and/or coke precursors;

g. removing the vapor phase from the flash/separation vessel;

h. adding steam to the vapor phase; and i. cracking the vapor phase in a radiant section of a pyrolysis furnace to produce an effluent comprising olefins, said pyrolysis furnace comprising a radiant section and a convection section.

28. A process for cracking a contaminated light hydrocarbon feedstock, said contaminated light hydrocarbon feedstock comprising non-volatile components and said process comprising:

a. mixing a heavy hydrocarbon feedstock with said contaminated light hydrocarbon feedstock to form a contaminated hydrocarbon feedstock blend having a $T_{98}$ at least about 28° C. (about 50° F.) higher than the $T_{98}$ of the contaminated light hydrocarbon feedstock;

b. heating said contaminated hydrocarbon feedstock blend;

c. feeding the contaminated hydrocarbon feedstock blend to a flash/separation vessel;

d. separating the contaminated hydrocarbon feedstock blend into a vapor phase and a liquid phase, said vapor phase comprising about 50 to about 98% of the contaminated hydrocarbon feedstock blend;

e. removing the vapor phase from the flash/separation vessel;

f. adding steam to the vapor phase; and g. cracking the vapor phase in a radiant section of a pyrolysis furnace to produce an effluent comprising olefins, said pyrolysis furnace comprising a radiant section and a convection section.

* * * * *